United States Patent [19]

Tash

[11] Patent Number: 4,745,641

[45] Date of Patent: May 24, 1988

[54] TOILET BOWL PLUNGER

[76] Inventor: George Tash, 18658 Chase St., Northridge, Calif. 91324

[21] Appl. No.: 867,790

[22] Filed: May 27, 1986

Related U.S. Application Data

[63] Continuation of Ser. No. 657,611, Oct. 4, 1984, abandoned.

[51] Int. Cl.[4] ..... E03D 11/00

[52] U.S. Cl. ..... 4/255; 4/257

[58] Field of Search ..... 4/255–257

[56] References Cited

U.S. PATENT DOCUMENTS

| | | | |
|---|---|---|---|
| 1,180,323 | 4/1916 | Schuh | 4/255 |
| 1,644,436 | 10/1927 | Locke | 4/256 |
| 2,126,689 | 8/1938 | Pouliot | 4/255 |
| 2,844,826 | 7/1958 | Cheiten | 4/257 |
| 3,336,604 | 8/1967 | Lacey et al. | 4/255 |
| 3,644,943 | 2/1972 | Parodi fu Leonardo et al. | 4/255 |
| 3,994,032 | 11/1976 | Spickofsky | 4/255 |

*Primary Examiner*—Charles E. Phillips

*Attorney, Agent, or Firm*—John J. Posta, Jr.

[57] ABSTRACT

The plunger includes an elongated knurled handle, a base sealing member having a central aperture extending therethrough, and a multi-pleated bellows preferably releasably connected to the bottom of the handle and preferably permanently connected to the top of the base sealing member. Preferably, the bellows and base sealing member are generally cylindrical and of rubber, plastic or the like. They may be integral. The sealing member may have an upper bowl sealing rim with a collapsable top wall adapted to receive the bellows, and a small diameter lower sealing ring, with depending skirt. Preferably, the transverse bellows pleats increase in diameter from the bellows top to bottom and may be arranged in sets for improved seating. The handle top can be removable and the handle can contain a central cavity extending longitudinally therethrough, which cavity can, if desired, be threaded to receive a garden hose. Thus, the handle top when unscrewed can act as a vacuum relief valve. The handle top can also include a padded transverse grip. The device is highly efficient and durable and is adapted for use in a variety of applications.

20 Claims, 3 Drawing Sheets

TOILET BOWL PLUNGER

This is a continuation, of application Ser. No. 657,611, filed Oct. 4, 1984, abandoned.

BACKGROUND OF THE INVENTION

1. Field of the Invention

The present invention generally relates to plumbing helpers and, more particularly, to an improved toilet bowl and drain plunger.

2. Prior Art

Conventional drain and toilet bowl plungers generally comprise a resilient rubber, smooth walled bell shaped plunger portion and a cylindrical handle connected to the upper end thereof. See, for example, U.S. Pat. Nos. 2,496,525; 2,066,773; and 2,042,372. Such devices parallel rubber vacuum pumps used for other purposes, such as the pump of U.S. Pat. No. 2,463,458. More exotically shaped bell drain plungers are illustrated in U.S. Pat. Nos. 2,188,960 and 2,844,826.

Conventional drain and toilet bowl plungers are generally characterized by being difficult to use. Thus, the rubber bell is initially very difficult to compress, then suddenly collapses. This causes a sudden shock on or surge to the drain and may loosen plumbing connections. Moreover, the rubber rim of the bell does not fit a toilet bowl properly to provide an effective seal, but slips around in the bowl, so that strong controlled pressure and vacuum cannot be exerted on the toilet drain to clear it of a blockage. While conventional plungers are generally better adapted for use in kitchen sinks, drain tubs and the like, they are seriously deficient for use with toilets, as pointed out above.

Accordingly, there remains a need for an improved toilet drain blockage removing device which allows a smoothly controlled amount of pressure and vacuum to be exerted on the toilet drain, so as to protect the drain from damage, and which is easy and efficient to use. The device preferably should be durable and have readily replaceable parts. The seal exerted by the device should be improved over conventional plungers to provide quicker better drain clearing results. Such device should be capable of being made in a variety of efficient configurations at low cost from readily available materials.

SUMMARY OF THE INVENTION

The improved toilet bowl plunger of the present invention satisfies all the foregoing needs. The plunger is substantially as set forth in the Abstract above. Thus, the plunger comprises an elongated handle, to the bottom of which is preferably releasably connected a pleated bellows. The bottom of the bellows is integrally connected to a base sealing member having a central aperture extending through it. The base member has an upper outer sealing rim and a collapsable upper wall, so that as the bellows is collapsed down thereinto, sealing at the rim is facilitated. The base member includes a narrow lower portion bearing a wear-resistant sealing ring, preferably from which depends a flexible sealing skirt.

The bellows pleats increase in diameter from the top to the bottom of the bellows and may be divided into stacked sets of different diameters. The pleats have sharply angular or rounded outer peripheries and are aligned transversely of the bellows. The wall thickness of the pleats can be essentially uniform or slightly less at the pleat intersections.

The handle may have a top cross bar of padded plate or a removable top cap or knob. The handle can have a central cavity extending from end to end and threaded at its upper end to receive a garden hose for pressure pump flushing with the plunger. The top cap can also act as a vacuum and pressure relief valve to facilitate removal of the plunger.

The handle can be knurled, decorative and generally cylindrical. The bellows and base member may be unitary, generally cylindrical and fabricated of flexible resilient rubber, plastic or the like. The device is durable, efficient, low cost and easy to use. The pressure and suction exerted by it can be easily controlled by varying the extent of compression or collapse of the bellows. Further features of the invention are set forth in the following detailed description and accompanying drawings.

DRAWINGS

DETAILED DESCRIPTION

Figure 1:
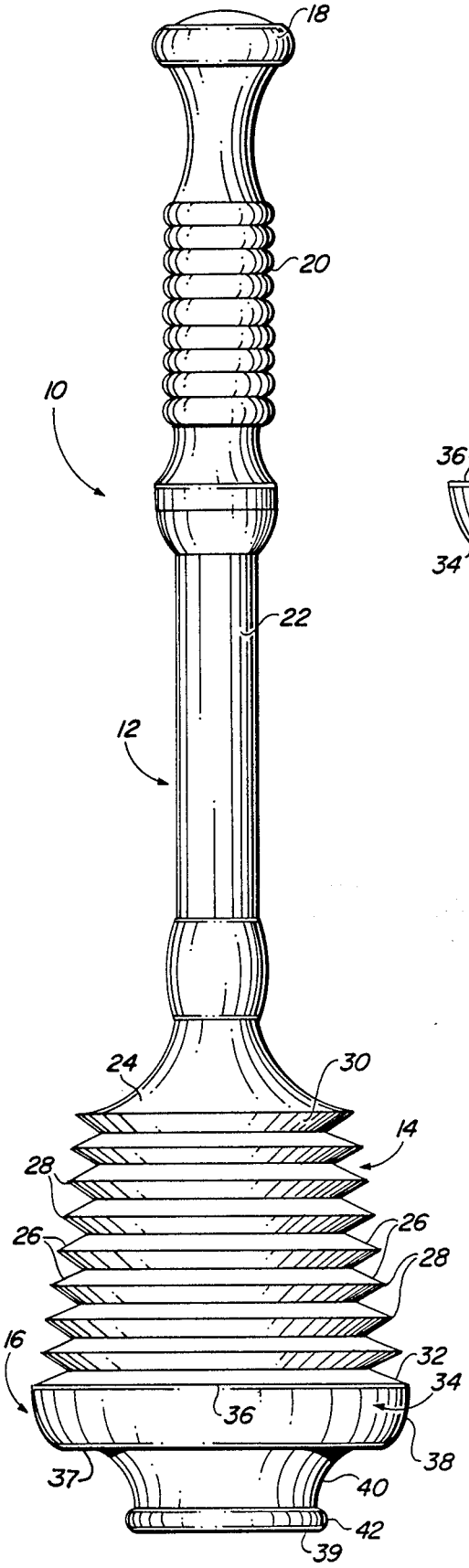
FIG. 1 is a schematic side elevation of a first preferred embodiment of the improved toilet bowl plunger of the present invention, shown in the relaxed uncompressed state.
Figure 2:
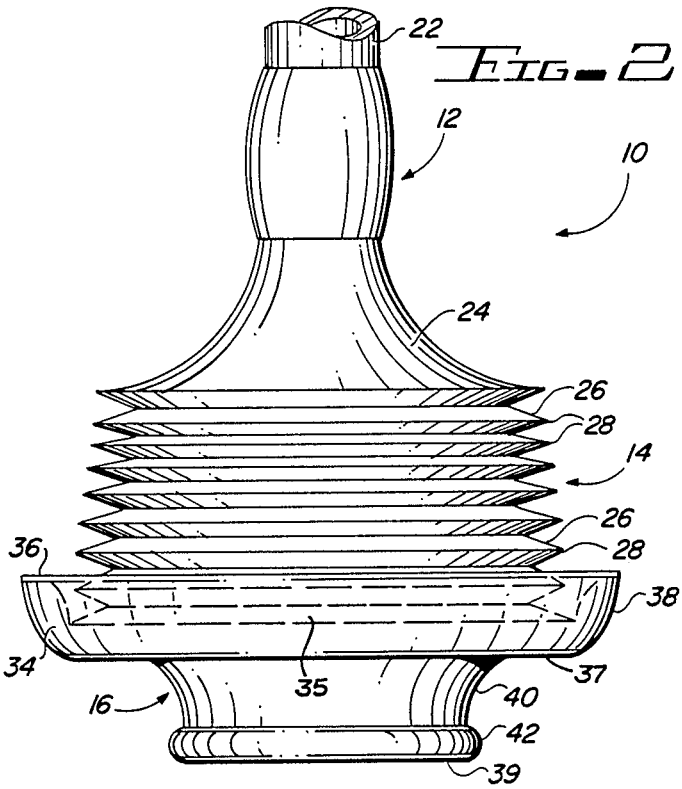
FIG. 2 is a somewhat enlarged schematic fragmentary side elevation of the bellows and base sealing member of the plunger of FIG. 1, shown with the bellows compressed (collapsed)

FIGS. 1 and 2

Now referring more particularly to FIGS. 1 and 2 of the drawings, a first preferred embodiment of the improved toilet bowl plunger of the present invention schematically depicted therein. Thus, plunger 10 is shown which comprises an elongated generally cylindrical handle 12, to the bottom end of which is connected, preferably releasably, a bellows 14, in turn connected, preferably integrally, at its lower end to a base sealing member 16.

Handle 12 may be of wood, ceramic, metal, plastic, rubber or the like and preferably has a top cap 18, a knurled grip 20, a decorative surface 22 and a flared base 24. Alternatively, portion 24 may be the upper end of bellows 14.

Bellows 14 is generally cylindrical and hollow, is made of resilient, flexible rubber or plastic, preferably blow molded, and includes a plurality of transverse pleats 26 with sharply angled outer peripheries 28. Pleats 26 gradually and uniformly increase in diameter from the top 30 of bellows 14 to the bottom 32 thereof to facilitate easy and controlled collapsing and nesting of bellows 14 into nesting area 35 formed within member 16 and more ready control of the extent of pressure and vacuum applied by bellows 14 to a toilet drain during operation of plunger 10. Bottom 32 is integrally connected to the upper portion 34 of member 16, which upper portion 34 includes a thin walled collapsible top 36 and a perpheral sealing rim 38. Member 16 is hollow, and includes a planar bottom portion 37 and nesting area 35 with an open bottom 39.

When, as shown in FIG. 2, bellows 14 is collapsed (compressed) so that its bottom 32 forces down top 36, rim 38 is deflected outwardly to more effectively seal plunger 10 against a toilet bowl into which plunger 10 may be inserted. The lower portion 40 of member 16 is sloped to a narrow bottom wear-resistant sealing ring 42 defining open bottom 39. Portion 40 is designed to fit down into the narrow bottom end or drain portion of a toilet bowl, with ring 42 seated therein in sealing engagement therewith for optional transfer of pressure and suction thereto and therefore optional drain block clearing efficiency.

On the down or compression stroke of handle 12, bellows 14 progressively exerts air pressure against such drain, while on the up stroke of handle 12 suction is exerted by bellows 14 on such drain to dislodge any obstruction. Efficient easily controlled pressure and suction are accomplished by the use of plunger 10 due to the seals effected by the shape of plunger 10 and the engagement of ring 42 and rim 38 with the toilet walls and to the nature of bellows 14. Plunger 10 can also be used to dislodge blocks in kitchen sinks, drain tubs, bath tubs, etc., with improved efficiency.

FIG. 3

Figure 3:
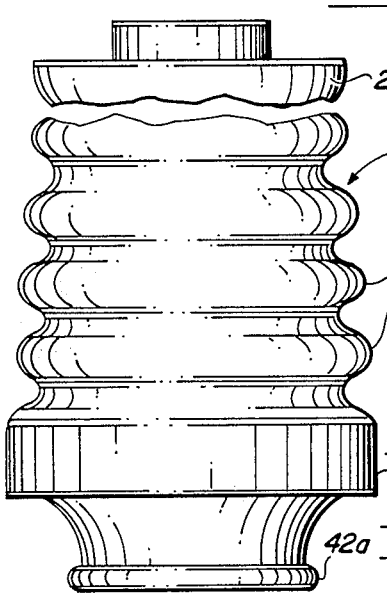
FIG. 3 is a schematic fragmentary side elevation, partly broken away, of a second preferred embodiment of the bellows and base member of the improved plunger of the present invention.

FIG. 3 schematically depicts a modified form of the bellows and base member of the improved plunger of the present invention. Thus, bellows **14*a* and base member 16*a* are shown. Components thereof similar to those of FIG. 1 bear the same numerals, but are succeeded by the letter "a". Bellows 14*a* differs from bellow 14 only in that pleats 26*a* thereof have curved or rounded outer peripheries 28*a* in contrast to the sharply angled pleats 26. Pleats 26*a* are uniformly thin walled. In addition, portion 24*a* has a squared off configuration. So also does rim 38*a*, in contrast to the rounded contours of rim 38. Bellows 14*a* and base member 16*a* are otherwise identical to bellows 14 and base member 16 and can be used with handle 12** to provide the present improved plunger.

FIG. 4

Figure 4:
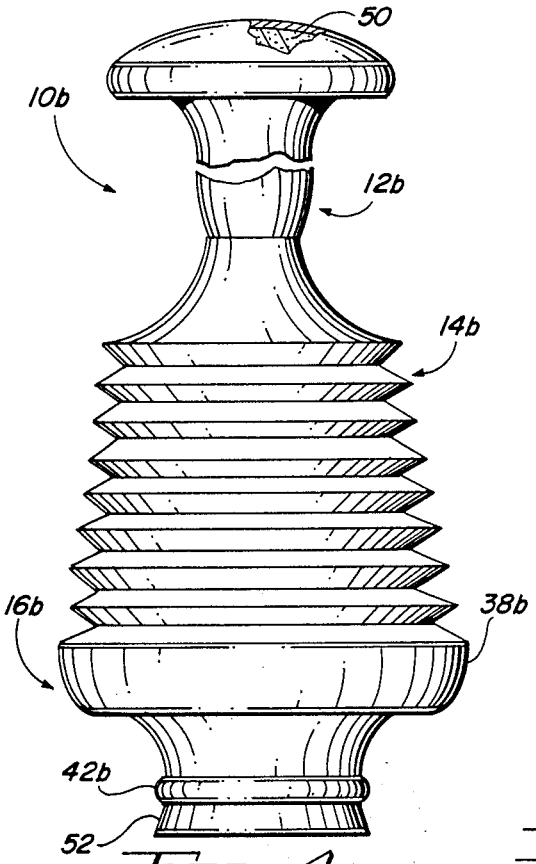
FIG. 4 is a schematic fragmentary side elevation of a third preferred embodiment of the improved plunger of the present invention.

A third preferred embodiment of the improved plunger of the invention is schematically depicted in FIG. 4. Thus, plunger **10*b* is shown. Components thereof similar to those of plunger 10 (FIG. 1) bear the same numerals, but are succeeded by the letter "b". Thus, plunger 10*b* includes handle 12*b*, bellows 14*b* and base member 16*b*. Handle 12*b* includes cap 18*b* which extends transversely of handle 12*b* and bears padding 50 to enable hand pressure to be exerted more efficiently on bellows 14*b***.

It will be noted that bellows **14*b* is identical to bellows 14 and that rim 38*b* is squared off in the manner of rim 38*a*. In addition, ring 42*b* has an annular, depending, resilient, flexible skirt 52 of rubber, plastic or the like depending therefrom, which skirt 52 aids in sealing plunger 10*b* to a toilet bowl drain. Thus, when bellows 14*b* is compressed, skirt 52 expands outwardly, directly contacting the toilet bowl surface defining the drain and thereby improving the seal effected by ring 42*b*. Thus, plunger 10*b*** is more efficient than conventional plungers.

FIG. 5

Figure 5:
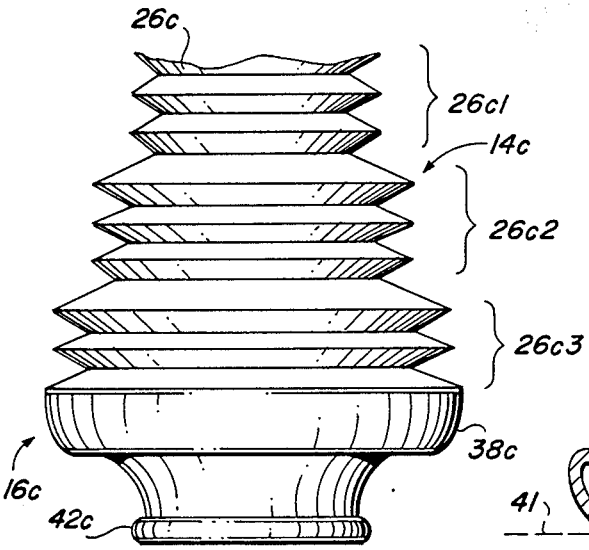
FIG. 5 is a schematic fragmentary side elevation of a fourth preferred embodiment of the bellows and base member of the improved plunger of the present invention.

A fourth preferred embodiment of the bellows and base member portion of the improved plunger of the present invention are schematically depicted in FIG. 5. Thus, bellows **14*c* and base member 16*c* are shown. Components thereof similar to those of bellows 14 and base member 24 bear the same numerals, but are succeeded by the letter "c". It will be noted that base member 16*c* is identical to base member 16 and that bellows 14*c* is identical to bellows 14, except that pleats 26*c* thereof are arranged in three sets 26*c*, 26*c*2 and 26*c*3 of increasing diameter, with the pleats 26*c* within each set substantially identical. This arrangement of pleats 26*c* further facilitates proper sequential collapsing or compression of bellows 14*c* and proper rebound of bellows 14*c* during use of the present plunger. Components 14*c* and 16*c* can be used with handle 12**.

FIG. 6

Figure 6:
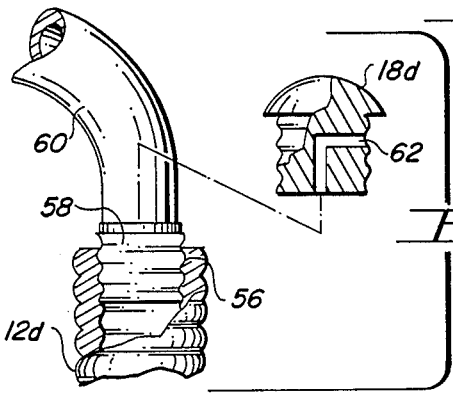
FIG. 6 is a schematic fragmentary side elevation, partly broken away, of a modified version of the top of the handle of the improved plunger of the present invention.

In FIG. 6 a modification of handle 12 of plunger 10 is shown. Thus, a portion of handle **12*d* is depicted schematically. Handle 12*d* is identical to handle 12 except that its cap 18*d* is threadably receivable in a central threaded cavity 56 extending the length of handle 12*d* into communication with the bellows thereof (not shown). Handle 12*d* can be substituted for handle 12. Cavity 56 is dimensioned to threadably receive the metal connector 58 of a garden hose 60, so that water under pressure can be delivered via hose 60 through handle 12*d***, and the associated bellows and hose member (not shown) to a toilet drain or other drain being worked on, for improved obstacle clearing efficiency.

It will be understood that with cap **18*d* (instead of hose 60) screwed tightly in place in cavity 56, air pressure can be fully applied by plunger 10. If it is desired to remove that pressure or the resulting suction, for example, in order to free plunger 10 from sealing engagement with a toilet, or to somewhat reduce the pressure or suction, in order to better control the forces delivered through the plunger, cap 18*d* can be unscrewed to expose bleed-off groove 62 thereof. Accordingly, the modifications of FIG. 6** are useful in the improved plunger of the invention.

FIG. 7

Figure 7:
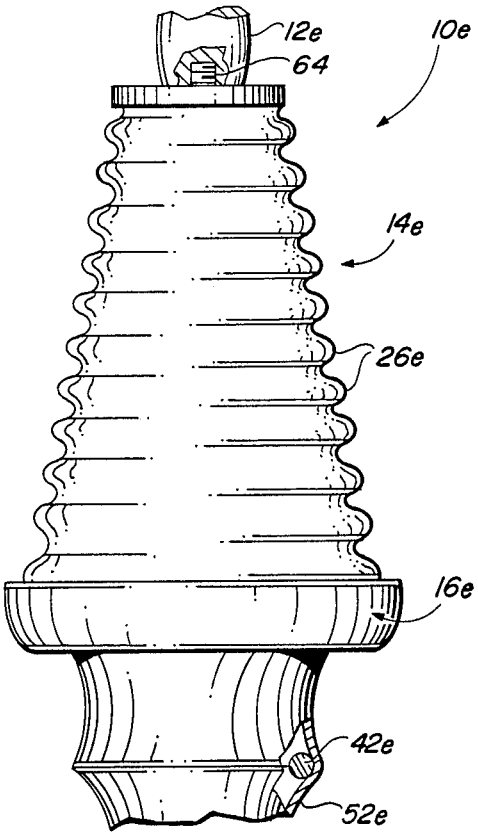
FIG. 7 is a schematic side elvation of a fifth preferred embodiment of the improved plunger of the present invention.

A fifth preferred embodiment of the improved plunger of the present invention is schematically depicted in FIG. 7. Thus, plunger **10*e* is shown. Components thereof similar to those of FIG. 1 bear the same numerals, but are succeeded by the letter "e". Thus, plunger 10*e* has handle 12*e* releasably secured, as by a screw 64, to bellows 14*e*. Bellows 14*e* is bee hive-shaped and includes rounded pleats 26*e* gradually increasing in diameter down to base member 16*e*. That member is similar to member 16, except that it includes an internal reinforcing ring 42*e* and a lower skirt 52*e* which slopes down and inwardly. All other components are the same as in plunger 10, and plunger 10*e*** functions similarly thereof.

FIG. 8

Figure 8:
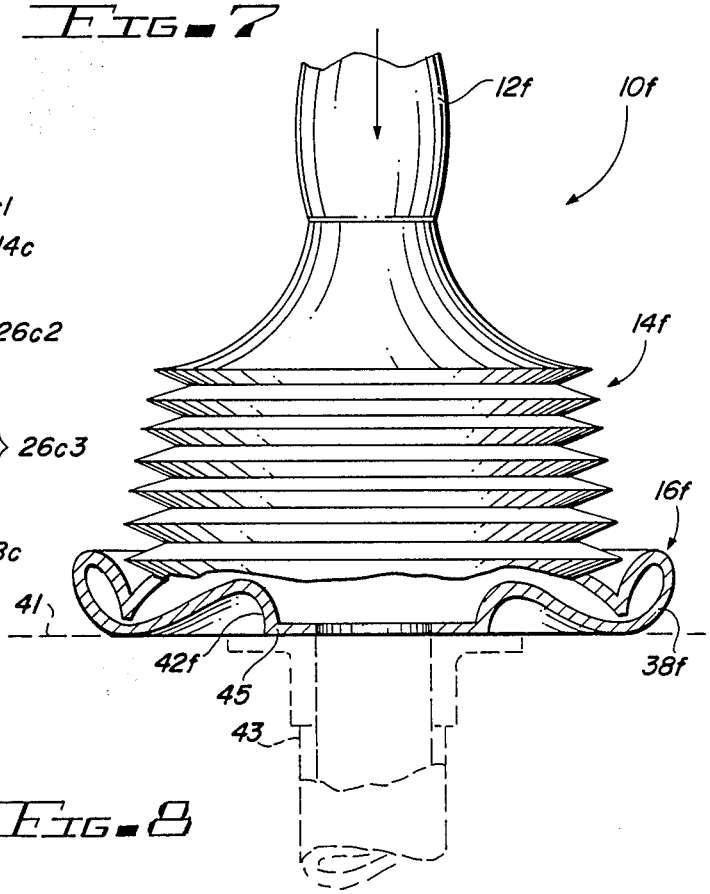
FIG. 8 is a schematic cutaway side elevation of a sixth preferred embodiment of the improved plunger of the present invention.

A sixth preferred embodiment of the improved plunger of the invention is schematically depicted in FIG. 8, with portions thereof cutaway to more clearly show the interior of the plunger. Components thereof similar to those of plunger 10 (FIG. 1) bear the same numerals, but are succeeded by the letter "f". Thus, plunger 10*f* includes 12*f*, bellows 14*f* and base member 16*f*.

Plunger 10*f* is shown in an operative position with handle 12*f* having been moved downwardly to compress bellows 14*f* and collapse rim portion 38*f*. Plunger 10*f* is shown in use on a flat surface 41 having a drain 43 terminating at flat surface 41. Plunger 10*f* has a rim 45 extending inwardly from ring 42*f* which provides an additional sealing surface around drain 43.

Plunger 10*f* has been designed to be especially applicable on flat surface drains. If the ordinary plunger is collapsed over a flat surface drain opening with the funnel extended, the plunger has a tendency to wabble all over the place, thereby uncovering the drain opening. Accordingly, presently available plungers generally require a tucking under of their funnels by hand when covering a flat drain, which is quite unsanitary. If the plunger were to be subsequently used in a toilet or other recessed drain, the funnel would then be required to be pulled outward, again resulting in an unsanitary operation. Applicant's plunger 10*f* avoids these problems by providing a plunger capable of effecting a double seal (via rim 45 and rim 38*f*) about a drain 43 on a flat surface 41 application without employing one's hands, and upon removal from drain 43, is ready for use in a toilet or other recessed drain.

Various other modifications, changes, alterations and additions can be made in the improved plunger of the present invention, its components and parameters. All such modifications, changes, alterations and additions as are within the scope of the appended claims form part of the present invention.

What is claimed is:

1. An improved drain clearing plunger, said plunger comprising, in combination:

(a) an elongated plunger handle having a bottom end;

(b) an annular flexible, resilient base sealing member having (1) a central aperture extending vertically therethrough;

(2) a planar bottom portion having an inner and an outer periphery lying in a substantially horizontal plane and extending at said inner periphery radially from said central aperture, (3) an annular peripheral sealing rim connected to and extending only upwardly and outwardly from said outer periphery of said bottom portion; the arcuate curvature of said sealing rim extending in the vertical directional terminating at a thin walled collapsible top, (4) said bottom portion and peripheral sealing rim defining a nesting are, (c) a flexible, resilient, collapsible, multi-pleated bellows having its upper end connected to said bottom end of said handle, the pleats of said bellows being generally transverse to the vertical;

(d) said thin walled collapsible top lying in a substantially horizontal plane and having an inner and an outer periphery and being connected at said outer periphery to a top portion of said peripheral sealing rim;

(e) said bellows having a lower end, said bellows being connected at its lower end to said inner periphery of said collapsible top, (f) whereby compression of said bellows results in the nesting of the lower end of said bellows into said nesting area along with movement of said peripheral sealing rim radially outwards.

2. The improved plunger of claim 1 wherein said bellows and base sealing member are unitary and wherein said handle is releasably secured thereto.

3. The improved plunger of claim 1 wherein said handle has a padded transversely extending upper end cap to facilitate operation of said bellows.

4. The improved plunger of claim 1 wherein said bellows and base sealing member are generally cylindrical and unitary and comprise rubber or plastic.

5. The improved plunger of claim 4 wherein said handle is generally cylindrical and knurled to provide a hand grip and has a flared bottom releasably connected to said bellows.

6. The improved plunger of claim 1 wherein said bellow pleats increase in diameter from about the top of said bellows to about the bottom thereof for improved bellows collapsibility.

7. The improved plunger of claim 6 wherein said bellows pleats uniformly increase in diameter from the top to the bottom of said bellows.

8. The improved plunger of claim 6 wherein said bellows has a plurality of sets of said pleats, the pleats within each set being of about uniform diameter.

9. The improved plunger of claim 6 wherein said pleats have sharply angled outer peripheries.

10. The improved plunger of claim 6 wherein said pleats have curved outer peripheries.

11. The improved plunger of claim 10 wherein said bellows has a bee-hive-like configuration and wherein the wall thickness of said pleats is substantially uniform.

12. The improved plunger of claim 1 wherein said handle includes a removable top and a central cavity extending longitudinally therethrough to said bellows and wherein the upper end of said cavity is threaded and dimensioned to threadably receive the threaded end of a garden hose.

13. The improved plunger of claim 12 wherein said handle has relief valve means extending to said handle cavity.

14. The improved plunger of claim 13, including an inwardly directed inner sealing rim connected to the bottom of said base sealing member to provide a further sealing function.

15. The improved plunger of claim 1, including (1) a secondary, resilient base sealing member having a smaller circumference than the circumference of said first sealing member; and (2) a flexible, resilient transition member disposed between and interconnecting said first and second sealing members.

16. The improved plunger of claim 15 wherein said base sealing member includes a wear resistant sealing ring.

17. The improved plunger of claim 16, including an inwardly directed inner sealing rim secured to said sealing ring.

18. The improved plunger of claim 17 wherein said plunger is adapted to be placed about a drain terminating in a flat surface and is capable of providing a plurality of sealing areas about said drain.

19. The improved plunger of claim 1 wherein said sealing areas are concentric.

20. The improved plunger of claim 19 wherein the lower end of said bellows is collapsible into said nesting area when used on a flat surface, but is automatically returned to its original position when removed from said flat surface.

* * * * *